US005365737A

United States Patent [19]

Moriya et al.

[11] Patent Number: 5,365,737

[45] Date of Patent: Nov. 22, 1994

[54] HYDRAULICALLY-OPERATED EQUIPMENT FOR CONSTRUCTION MACHINERY

[75] Inventors: Yukio Moriya; Takeshi Kobayashi; Takumi Onoda; Fujitoshi Takamura; Toshio Yokoyama, all of Hirakata, Japan

[73] Assignee: Komatsu Ltd., Tokyo, Japan

[21] Appl. No.: 168,720

[22] Filed: Dec. 16, 1993

Related U.S. Application Data

[63] Continuation of Ser. No. 920,463, Aug. 19, 1992, abandoned.

[51] Int. Cl.[5] ..... F16D 31/02; F16D 33/00

[52] U.S. Cl. ..... 60/469; 60/325; 60/327

[58] Field of Search ..... 60/325, 459, 445, 431, 60/433, 434, 443, 450, 452, 462, 465, , 395, 469, 327; 91/459, 518, 461

[56] References Cited

U.S. PATENT DOCUMENTS

| | | | |
|---|---|---|---|
| 3,902,319 | 9/1975 | Olmsted | 60/469 X |
| 4,524,582 | 6/1985 | Lucas et al. | 60/421 |
| 4,586,330 | 5/1986 | Watanabe et al. | 60/421 |
| 4,753,158 | 6/1988 | Hirata et al. | 91/461 |
| 5,029,067 | 7/1991 | Nishida et al. | 60/421 |
| 5,048,296 | 9/1991 | Sunamura et al. | 60/469 X |

FOREIGN PATENT DOCUMENTS

| | | |
|---|---|---|
| 78805 | 12/1978 | Japan . |
| 213927 | 6/1982 | Japan . |
| 160331 | 1/1986 | Japan . |
| 62-0171941 | 7/1987 | Japan . |
| 63-270548 | 10/1988 | Japan . |

*Primary Examiner*—Edward K. Look
*Assistant Examiner*—Hoang Nguyen
*Attorney, Agent, or Firm*—Senniger, Powers, Leavitt & Roedel

[57] ABSTRACT

Hydraulically-operated equipment such as travelling equipment or working equipment for use in construction machinery such as a power shovel, shoveldozer and bulldozer. The hydraulically-operated equipment comprises a hydraulic driving mechanism actuated by hydraulic pressure, a hydraulic pressure supplying device for supplying hydraulic pressure to a hydraulic pipeline system for the hydraulic driving mechanism and a controller for controlling the hydraulic pressure supplying device such that the supplying rate at which hydraulic pressure is supplied to the hydraulic pipeline system according to the supply of hydraulic pressure is decreased in a specified period after a dead zone period in which hydraulic pressure starts to rise. This arrangement prevents an operational lag in the hydraulic driving mechanism as well as a shock at the time of start-up and shut-down.

14 Claims, 1 Drawing Sheet

HYDRAULICALLY-OPERATED EQUIPMENT FOR CONSTRUCTION MACHINERY

This is a continuation, of application Ser. No. 07/920,463, filed Aug. 19, 1992, now abandoned, which is a national stage application of international application PCT/JP90/00195 filed Feb. 20, 1990, which designated the United States.

TECHNICAL FIELD

The present invention relates to hydraulically-operated equipment such as travelling equipment and working equipment for use in construction machinery such as a power shovel, shoveldozer and bulldozer. Among the working equipment are buckets, tilting apparatus, slewing apparatus etc.

BACKGROUND ART

In one known type of hydraulically-operated equipment such as travelling equipment and working equipment which are provided in the aforesaid construction machines according to the needs of various kinds of construction work including travelling and working operations, hydraulic pressure for actuating the hydraulic driving mechanism which is driven by hydraulic pressure in the hydraulically-operated equipment is supplied, at a constant supply rate, to the pipeline system of the hydraulic driving mechanism, by means of hydraulic controller valves, hydraulic pumps and similar devices. In other words, the hydraulic driving mechanism is driven by hydraulic pressure, the pressure being supplied at such a constant supply rate that it rises and drops rectilinearly .

Such hydraulically-operated equipment, however, has the following disadvantages: since hydraulic pressure is supplied at a constant supply rate, when a high supply rate is adopted, the hydraulic driving mechanism driven by hydraulic pressure abruptly starts or stops its operation immediately after a dead zone period during which hydraulic pressure starts to rise. As a result of this, the mechanism receives a great shock at the time of start-up and shut-down. On the other hand, when the supply rate is low, the operation of the hydraulic driving mechanism driven by hydraulic pressure becomes sluggish so that there occurs a lag in the operation although the mechanism is free from a shock at the time of its start-up and shut-down.

This is a serious problem, particularly in the use of hydraulically-operated equipment in which more than two operation speed modes, e.g., a high travelling-speed mode can be selected, and low travelling-speed mode; and digging mode (i.e., normal speed mode) and moderating mode (i.e., half speed mode), because a great shock is caused at the time of start-up and shut-down in one mode while in with the other mode an operational lag occurs.

It is therefore a prime object of this invention to provide hydraulically-operated equipment for use in construction machinery which is capable of overcoming the foregoing disadvantages by eliminating a shock at the time of start-up and shut-down and preventing a lag in the operation.

SUMMARY OF THE INVENTION

In order to accomplish the above object, the hydraulically-operated equipment according to this invention comprises:

(a) a hydraulic driving mechanism actuated by hydraulic pressure supplied to it through a hydraulic pipeline system;

(b) hydraulic pressure supplying means for supplying hydraulic pressure to the hydraulic pipeline system of the hydraulic driving mechanism; and (c) a controller for controlling the hydraulic pressure supply means such that the supplying rate at which hydraulic pressure is supplied to the hydraulic pipeline system, the rate being based on the supply of hydraulic pressure, is decreased during a specified period after a dead zone period in which hydraulic pressure starts to rise.

In the above arrangement, the controller may include a plurality of control modulation patterns of the hydraulic pressure supply means for determining the supplying rate at which hydraulic pressure is supplied to the hydraulic pipeline system and may control the hydraulic pressure supply means according to one of the control modulation patterns which has been selected in compliance with an operation mode. The hydraulic pressure supply means may be a hydraulic controller valve and/or hydraulic pump.

According to the invention, this hydraulic pressure supply rate at the hydraulic pipeline system, namely, the rising and dropping rates of hydraulic pressure are decreased during a specified period (represented by the period between I and II in FIG. 2) in the operating zone period, the specified period succeeding the dead zone period in which hydraulic pressure starts to rise. In other words, the motion of the hydraulic driving mechanism is made sluggish by decreasing the hydraulic pressure supplying rate in the specified period in which great momentum is imparted to the hydraulic driving mechanism. On the other hand, the motion of the hydraulic driving mechanism is made fast by maintaining the hydraulic pressure supply rate to be high in the dead zone period and the operating zone period excluding the above specified period. During those periods, great momentum is not imparted to the hydraulic driving mechanism. The above arrangement makes it possible to prevent such an undesirable situation that the working state of the hydraulic driving mechanism is abruptly changed. Therefore, the entire operation of the hydraulic driving mechanism is carried out so smoothly that a shock which-may occur at the time of start-up and shut-down is prevented. Further, a delay in the operation can be positively avoided since the operation of the hydraulic driving mechanism is kept at a high speed in the dead zone period and in the operating zone period excluding the specified period. In the case where the equipment has more than two operation modes having different operation speeds, the unfavourable situation in which a shock occurs in one mode at the time of start-up and shut-down whilst an operational lag occurs in the other mode will no longer happen.

BRIEF DESCRIPTION OF THE DRAWINGS

FIG. 1 is a block diagram of a hydraulic system and FIG. 2 graphically shows the control modulation patterns.

DETAILED DESCRIPTION OF THE PREFERRED EMBODIMENT

Reference is now made to the drawings for explaining an embodiment of hydraulically-operated equipment for construction machinery according to the invention.

A construction machine with crawler belts which moves back and forth and slews freely, such as a power shovel, for example, is provided with working equipment such as a bucket, tilting apparatus or slewing apparatus which is hydraulically-operated equipment. Such working equipment has a hydraulic system as shown in FIG. 1.

Figure 1:
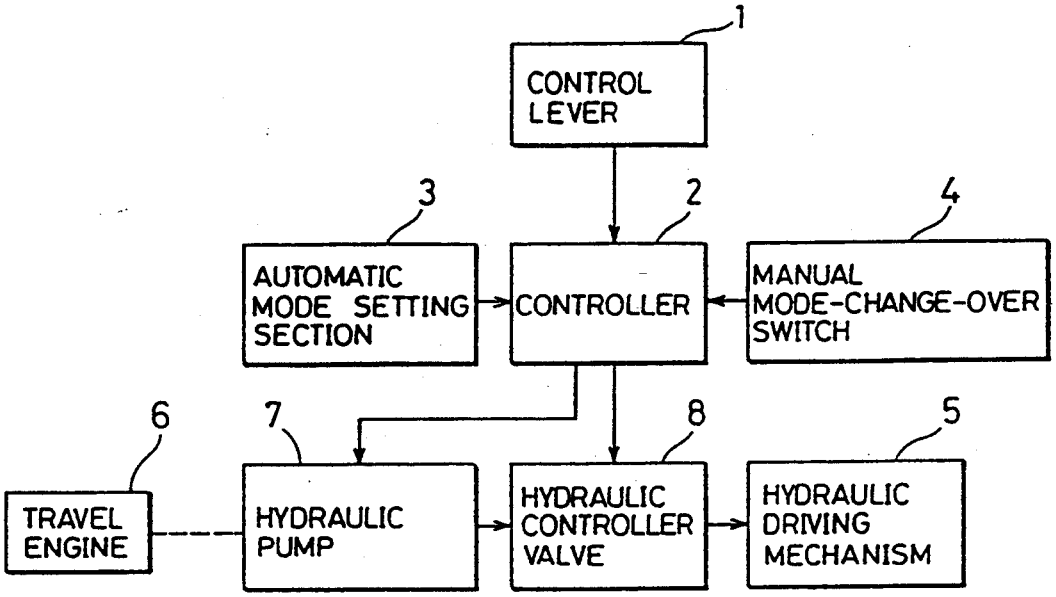
FIGS. 1 and 2 illustrate the preferred embodiment of hydraulically-operated equipment for construction machinery according to the invention.

In FIG. 1, an operation signal generated according to the operating conditions of a control lever 1 consisting of an electric lever is supplied to a controller 2. The above operating conditions are, concretely, rapid operation (represented by the dashed line a in FIG. 2), normal operation (the dashed line b), slow operation (the dashed line c) and reverse operation (the dashed line z). Those operations are carried out at control speeds in the range from the minimum value "0" to the maximum value "full stroke" and will be described later in detail. The controller 2 is also provided with set mode signals from an automatic mode setting section 3 and a manual mode-change-over switch 4. The set mode signals are each based on one of a number of operation modes such as an digging mode, moderating mode etc., the operation mode being specified by the automatic mode setting section 3 or the manual mode-change-over switch 4. The automatic mode setting section 3 is for automatically selecting one operation mode according to operational requirements of the construction machine and particularly the working equipment. The manual mode-change-over switch 4 is operated by the operator to select one of the above operation modes in accordance with the working state of the machine. In accordance with the operation signal from the control lever 1 and the set mode signals from the automatic mode setting section 3 and the manual mode-change-over switch 4, the controller 2 controls the rate at which hydraulic pressure is supplied to the hydraulic pipeline system of a hydraulic driving system 5 provided in a bucket, tilting apparatus or slewing apparatus, by selecting one of preset control modulation patterns (in this embodiment, three patterns are preset) More specifically, the pumping rate of a hydraulic pump 7 actuated by a travel engine 6 for driving the construction machine to travel back and forth and slew and the spool drive of a hydraulic controller valve 8 for determining the flow path and flow rate of hydraulic oil Pressurised by the hydraulic pump 7 are increased or decreased whereby the controller 2 controls the hydraulic pressure supply rate according to selected one of the control modulation patterns.

When the operator specifies a setting which allows the operation modes to be selectively changed by the manual mode-change-over switch 4, the controller 2 processes the set mode signal sent from the manual mode-change-over switch 4 in preference to the set mode signal from the automatic mode setting section 3.

Now there will be given an explanation on-the relationship between the operation modes to be selected by the automatic mode setting section 3 or the manual mode-change-over switch 4 and the three control modulation patterns installed in the controller 2 whilst making reference to FIG. 2. The continuous lines A, B and Z represent the three types of control modulation patterns.

Figure 2:
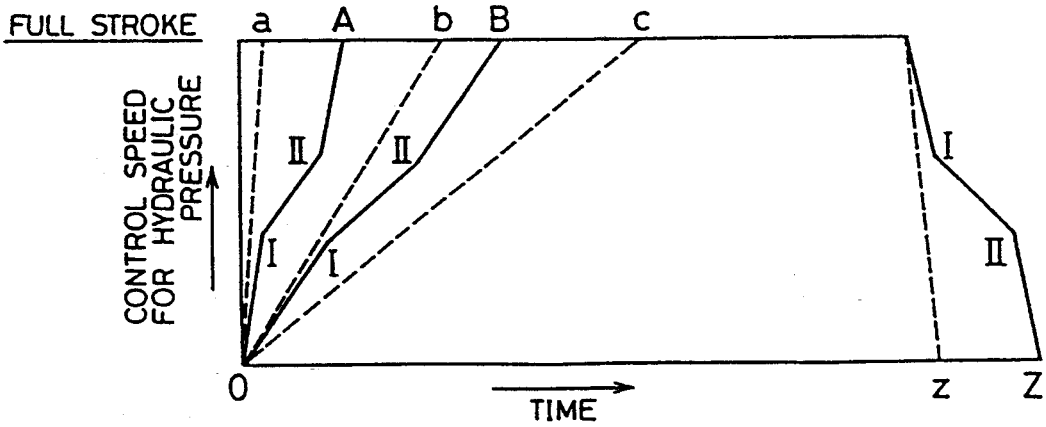

As shown in FIG. 2, except for the dead zone period (the initial period) in which hydraulic pressure starts to rise and the latter operating zone period (the closing period) during which great momentum is not imparted to the hydraulic driving mechanism 5, each of the control modulation patterns A, B and Z achieves satisfactory operational effects after the rise of hydraulic pressure. In the former operating zone period (the middle period from I to II) during which great momentum is imparted to the hydraulic driving mechanism 5, this period being at the middle of the stroke and accounting for about 30% of it in this embodiment, the hydraulic pressure supply rate is set less than those of the other periods. In short, in the former operating zone period during which great momentum is imparted to the hydraulic driving mechanism 5, the movement of the hydraulic driving mechanism 5 is restrained thereby preventing a shock caused at the time of start-up and shutdown. On the other hand, in the dead zone period and in the latter operating zone period during which the hydraulic driving mechanism 5 is not subject to great momentum, the hydraulic pressure supply rate is not decreased but maintained to be high so that an operational lag is prevented. Decreasing the hydraulic pressure supply rate in the former operating zone period not only can prevent a shock to the mechanism but it also can prevent cavitation which may be caused in the hydraulic pipeline system by the hydraulic pump 7.

The controller 2 selects, in the following manner, one of the control modulation patterns A, B and Z in accordance with the operation mode specified by the automatic mode setting section 3 or the manual mode-change-over switch 4.

Taking working equipment for a power shovel for instance, with the digging mode, the control modulation pattern B is selected so that no great shock will occur and the operation will be carried out in a smooth and gentle manner in the course of heavy digging operation. With the moderating mode on the other hand, the control modulation pattern A is selected so that there will occur no operational lag. Regarding travelling equipment, when the high travelling-speed mode is set, the control modulation pattern B causing less shocks is selected to reduce the influence of inertia, and when the low travelling-speed mode is selected, the control modulation pattern A causing no operational lag is selected. When the control lever 1 is reversely operated such that the control speed drops from a "full stroke" value to "0", the control modulation pattern Z is always selected regardless of the operation mode that has been set or specified.

Referring to FIG. 2, the control operation of the hydraulic pressure supplying rate will be explained in connection with the relationship between the control modulation patterns A, B and Z to be selected and the operating conditions of the control lever 1.

In FIG. 2, the dashed line a represents the rapid operating condition in which the control lever 1 is operated such that the speed at which hydraulic pressure is controlled increases from its minimum value (i.e., "0") to its maximum value (i.e., "full stroke" value) in an instant, thereby instantaneously increasing the hydraulic pressure supply rate. The dashed line c represents the slow operating condition in which the control lever 1 is operated such that the control speed increases slowly from "0" to the "full stroke" value, thereby gradually increasing the hydraulic pressure supply rate. The dashed line b represents the normal operating condition in which the control speed is intermediate between those of the rapid operating condition and the slow operating condition. The dashed line z represents the reverse operating condition in which the control speed decreases with a profile similar to that of the rapid operating condition when it is inverted. In the rapid operating condition represented by the dashed line a, the normal operating condition represented by the dashed line b and the reverse operating condition represented by the dashed line z, if hydraulic pressure is supplied at a constant supply rate as indicated by the respective straight dashed lines a, b and z, a shock will inevitably occur at the time of the start-up and shut-down of the hydraulic driving mechanism 5. The shock is considerable especially in the rapid and reverse operating conditions since the control speed of the control lever 1 instantaneously reaches the "full stroke" value or "0".

If the control modulation pattern A is selected on the basis of a selected operation mode when the control lever 1 is in the rapid operating condition indicated by the dashed line a, the hydraulic pressure supply rate will be controlled in compliance with the control modulation pattern A. If the control modulation pattern A is selected when the control lever 1 is in the normal operating condition or slow operating condition indicated by the dashed lines b and c respectively, the hydraulic pressure supply rate will continue to be controlled in compliance with the pattern of the respective operating conditions. This arrangement enables the operational lag of the hydraulic driving mechanism 5 and the occurrence of a shock to be prevented at least in the rapid operating condition.

If the control modulation pattern B is selected when the control lever 1 is in the rapid operating condition or normal operation condition indicated by the dashed lines a and b respectively, the supply rate will be controlled in compliance with the control modulation pattern B. If the control modulation pattern B is selected when the control lever 1 is in the slow operating condition indicated by the dashed line c, the supply rate will continue to be controlled in compliance with the pattern of the slow operating condition. With the above arrangement, the operational lag of the hydraulic driving mechanism 5 and the occurrence of a shock can be prevented both in the rapid and normal operating conditions.

Similarly, if the control modulation pattern Z is selected when the control lever 1 is in the reverse operating condition represented by the dashed line z, the hydraulic pressure supply rate will be controlled in compliance with the control modulation pattern Z so that the operational lag and the occurrence of a shock can be prevented.

In the above embodiment, the rate at which hydraulic pressure is supplied to the hydraulic pipeline system is decreased in a specified period after the dead zone period in which hydraulic pressure starts to rise, according to the preset control modulation patterns A, B and Z, however the invention is not necessarily limited to this arrangement. For example, the supply rate may be decreased in a specified period under the calculation directly from the respective patterns of the operating conditions of the control lever 1 whereby an operational lag and the occurrence of a shock are prevented.

INDUSTRIAL APPLICABILITY

The arrangement disclosed in the invention is capable of preventing a shock which may occur at the time of the start-up and shut-down of the hydraulic driving mechanism as well as an operational lag, and therefore it is most suitably applied not only to working equipment for construction machinery such as a bucket, tilting apparatus, slewing apparatus but also to travelling equipment for construction machinery.

We claim:

1. Hydraulically-operated equipment for construction machinery comprising:

(a) a hydraulic driving mechanism actuated by hydraulic pressure supplied by a hydraulic pipeline system;

(b) hydraulic pressure supply means for supplying hydraulic pressure to the hydraulic pipeline system for the hydraulic driving mechanism; and (c) a controller for controlling the hydraulic pressure supply means such that the hydraulic pressure supplied to the hydraulic driving mechanism via said hydraulic pipeline increases at a first rate during a dead zone period in which the hydraulic pressure starts to rise without causing movement of the hydraulic driving mechanism, and then at a decreased rate for a period immediately following the dead zone period, to reduce shock on start-up or shut-down.

2. The hydraulically-operated equipment for construction machinery according to claim 1, wherein the controller includes a plurality of control modulation patterns of the hydraulic pressure supplying means for determining the supply rate at which hydraulic pressure is supplied to the hydraulic pipeline system and for controlling the hydraulic pressure supply means according to one of the control modulation patterns which has been selected in compliance with the operational mode of the equipment.

3. The hydraulically-operated equipment for construction machinery according to claims 1 or 2, wherein said hydraulic pressure supply means is a hydraulic controller valve and/or hydraulic pump.

4. The hydraulically-operated equipment for construction machinery according to claims 1 or 2, wherein said hydraulic pressure supply means is a hydraulic controller valve and hydraulic pump.

5. The hydraulically-operated equipment for construction machinery according to claims 1 or 2, wherein said hydraulic pressure supply means is a hydraulic pump.

6. The hydraulically-operated equipment for construction machinery according to claims 1 or 2 wherein the controller decreases the supply rate of hydraulic pressure for a predetermined period.

7. A construction machine having at least one hydraulically-operated piece of equipment comprising a hydraulic driving mechanism for the piece of equipment actuated by hydraulic pressure supplied by a hydraulic pipeline system; a hydraulic pressure supply means for supplying hydraulic pressure to the hydraulic pipeline system for the hydraulic driving mechanism; and a controller for controlling the hydraulic pressure supply means such that the hydraulic pressure supplied to the hydraulic driving mechanism via said hydraulic pipeline increases at a first rate during a dead zone period in which the hydraulic pressure starts to rise without causing movement of the hydraulic driving mechanism, and then at a decreased rate for a period immediately following the dead zone period, to reduce shock to the mechanism upon start up or shut-down.

8. The construction machine according to claim 7 wherein the controller reduces the rate at which hydraulic pressure is supplied to the hydraulic pipeline system for a predetermined period.

9. The construction machine according to claim 7 wherein the controller controls the rate at which hydraulic pressure is supplied to the hydraulic pipeline system according to a predetermined control modulation pattern.

10. The construction machine according to claim 9 wherein the controller controls the rate at which hydraulic pressure is supplied to the hydraulic pipeline system according to one of a number of predetermined control modulation patterns.

11. A method of controlling hydraulically-operated equipment in a construction machine, the equipment comprising a hydraulic driving mechanism actuated by hydraulic pressure supplied by a hydraulic pipeline system, and a hydraulic pressure supply means for supplying hydraulic pressure to the hydraulic pipeline system for the hydraulic driving mechanism, the method comprising supplying hydraulic pressure to the hydraulic pipeline system at a first rate of increase during a dead zone period in which the hydraulic pressure starts to rise without causing movement of the hydraulic driving mechanism, and decreasing the rate at which hydraulic pressure is supplied to the hydraulic pipeline system immediately after the dead zone period, to reduce shock to the hydraulic driving mechanism upon start-up of the mechanism.

12. The method of controlling hydraulically operated equipment according to claim 11 wherein the rate at which hydraulic pressure is supplied to the hydraulic pipeline system is reduced for a predetermined period.

13. The method of controlling hydraulically operated equipment according to claim 11 wherein the rate at which hydraulic pressure is supplied to the hydraulic pipeline system is determined according to a predetermined control modulation pattern.

14. The method of controlling hydraulically operated equipment according to claim 13 wherein the rate at which hydraulic pressure is supplied to the hydraulic pipeline system is determined according to one of a number of predetermined control modulation patterns.

* * * * *